US006991408B2

(12) United States Patent
Bottriell et al.

(10) Patent No.: US 6,991,408 B2
(45) Date of Patent: Jan. 31, 2006

(54) SOIL REPLACEMENT PRODUCT

(75) Inventors: Phil Bottriell, Kanata (CA); David Vandenbeek, Kanata (CA)

(73) Assignee: North American Profill Products Inc., Kanata (CA)

( * ) Notice: Subject to any disclaimer, the term of this patent is extended or adjusted under 35 U.S.C. 154(b) by 0 days.

(21) Appl. No.: 10/424,946

(22) Filed: Apr. 29, 2003

(65) Prior Publication Data

US 2004/0218986 A1 Nov. 4, 2004

(51) Int. Cl.
*E02B 11/00* (2006.01)
*E02D 17/12* (2006.01)

(52) U.S. Cl. ..... 405/302.7; 405/43; 405/50; 210/170; 210/747

(58) Field of Classification Search ..... 405/32, 405/36, 43, 45, 50, 302.6, 302.7; 210/170, 210/747, 282
See application file for complete search history.

(56) References Cited

U.S. PATENT DOCUMENTS 3,617,566 A * 11/1971 Oshima et al. ..... 210/282
4,983,068 A * 1/1991 Kozak et al. ..... 405/36
4,986,699 A * 1/1991 Bohnhoff ..... 405/50
5,015,123 A * 5/1991 Houck et al. ..... 405/45
5,051,028 A * 9/1991 Houck et al. ..... 405/45
5,385,430 A 1/1995 Connors ..... 405/157
5,535,499 A * 7/1996 Houck et al. ..... 29/428
5,584,599 A 12/1996 Knittel ..... 405/15
5,639,364 A * 6/1997 Houck et al. ..... 210/170
6,109,835 A * 8/2000 Grabhorn ..... 405/302.6
6,173,483 B1 * 1/2001 Houck et al. ..... 29/407.09
6,315,493 B2 * 11/2001 Malone et al. ..... 405/45
6,368,499 B1 * 4/2002 Sharpless ..... 210/282
6,390,154 B1 5/2002 Hall ..... 141/314
6,443,652 B1 * 9/2002 Houck et al. ..... 405/46
6,547,493 B2 * 4/2003 Spangler et al. ..... 405/302.6
2004/0022583 A1 * 2/2004 Bussey et al. ..... 405/43

FOREIGN PATENT DOCUMENTS

JP 60156826 * 8/1985 ..... 405/18

* cited by examiner

*Primary Examiner*—Jong-Suk (James) Lee
(74) *Attorney, Agent, or Firm*—Ogilvy Renault LLP; Paul S. Sharpe

(57) ABSTRACT

A lightweight, non water retaining, biodegradable soil replacement material which may be charged into a flexible non biodegradable synthetic bag. The fill material may be expanded polymeric materials to afford lightweight, insulation and adequate drainage which may be charged into a flexible bag having a mesh composition. The product may be used against foundations, walls, retaining walls, piers, columns, weeping tiles or any other structure where backfill is required. The product may have other applications due to its insulating ability which do not include soil replacement but may simply be to fill a space or opening.

13 Claims, 3 Drawing Sheets

SOIL REPLACEMENT PRODUCT

CROSS-REFERENCE TO RELATED APPLICATIONS

This is the first application filed for the present invention.

1. Technical Field

The present invention relates to low weight, non or minimal water retaining, non-biodegradable, soil replacement material contained in a properly constructed and fastened permeable bag.

2. Background of the Invention

Generally speaking, once existing soil is excavated from a construction site the decision to replace the soil is a difficult one usually requiring engineering analysis. The native soil is sometimes reused but this is generally undesirable if it is not consistent and free draining. In most instances the soil is replaced with imported natural aggregate materials such as stone, gravel, and sand. These imported materials are expensive to transport. They also are labour intensive to install and may require the use of large machinery. On difficult sites with existing structures the work could become very labour intensive.

A further limitation with existing soil replacement materials is the lack of long term drainage capacity, possibly increases in the weight compared to the soil replaced, and a lack of insulating ability. In colder climates, the possibility of structural damage due to freezing soil is also not fully eliminated. In the example where a contractor is undertaking a repair on a structure or wall, the contractor is required to combine different construction materials applied in a very strict and complicated manner to try and provide the engineering requirements to insure no further damage to the structure occurs. The drainage, loading and insulation requirements set out by the engineer will likely be expensive and difficult to accomplish.

It would be desirable to have a light weight, soil replacement product with a multitude of applications that would provide suitable drainage and reduced loading with some insulating characteristics. It should be easily conformable to the opening into which it is to be charged like other materials. It must also be easier to transport and install to reduce the labour and machinery costs associated with other materials.

A final important aspect of a soil replacement product is that it must not exhibit unusual or unacceptable characteristics as compared to other natural soil replacement materials. The multitude of applications for a soil replacement product will allow some flexibility, however the final analysis must insure a reasonable margin of safety is maintained when using any soil replacement product.

The present invention is focused upon satisfying the requirements which have been overlooked by prior art techniques by combining a lightweight soil replacement material in a permeable bag. This light weight, non water retaining, non-biodegradable product will provide good, long term water drainage, reduced loading on structures, insulating ability and will insure reasonable margin of safety characteristics similar to existing natural soil replacement materials.

SUMMARY OF THE INVENTION

One object of one embodiment of the present invention is to provide a lightweight, non water retaining, non-biodegradable soil replacement product with an improved method of employing the same.

A further object of one embodiment of the present invention is to provide a lightweight, non or minimal water retaining, non-biodegradable soil replacement material contained in a permeable bag, comprising:

- a permeable and flexible container composed of a non biodegradable material capable of allowing the passage of moisture there through; and
- a lightweight non water retaining, non biodegradable, material disposed within the bag, the bag when filled with the material providing a conformable, soil replacement material to fill an opening.

Advantageously, by providing the lightweight material in the bag, the overall weight of the product is significantly reduced compared to a similar volume of natural material, improving the ease of handling and reducing the loading characteristics of the volume of soil replaced. A particularly useful feature of the product is the ability to create air voids which most certainly will provide a resistance to heat flow. This will give the product an R-value or thermal resistance quality which is required in many construction and engineering situations.

In respect of the material of which the bag is made, the material which provides the requisite strength will depend on the environment in which the bag is used and can be selected by the designer.

A further object of one embodiment of the present invention is to provide a method of filling an area to be backfilled, comprising:

providing a synthetic permeable and flexible bag composed of a non biodegradable material capable of allowing the passage of moisture there through;

providing light weight, non water retaining, non bio-degradable material disposed within the container;

filling the bag with the material;

sealing the bag; and positioning a charged bag in the opening to be filled by conforming the bag to the volume of the opening.

The ease of use makes the product particularly well suited to a host of applications. The ability to open and reseal the bag would allow for flexible use where the specific size of the space to be filled is variable. As a useful feature, the otherwise closed container having the sealable opening could include a zipper type fastener or conventional bag sealer which would allow for adjustment of the amount of material in the bag.

As an option, the individual bags may also be reconfigurable into an assembly by using individual containers connected either end to end or atop one another. In order to maintain the connection, fasteners will be employed such as ties, zippers, heat, tape inter alia.

Having thus generally described the invention, reference will now be made to the accompanying drawings illustrating preferred embodiments.

BRIEF DESCRIPTION OF THE DRAWINGS

Similar numerals denote similar elements.

DETAILED DESCRIPTION OF THE PREFERRED EMBODIMENTS

Figure 1:
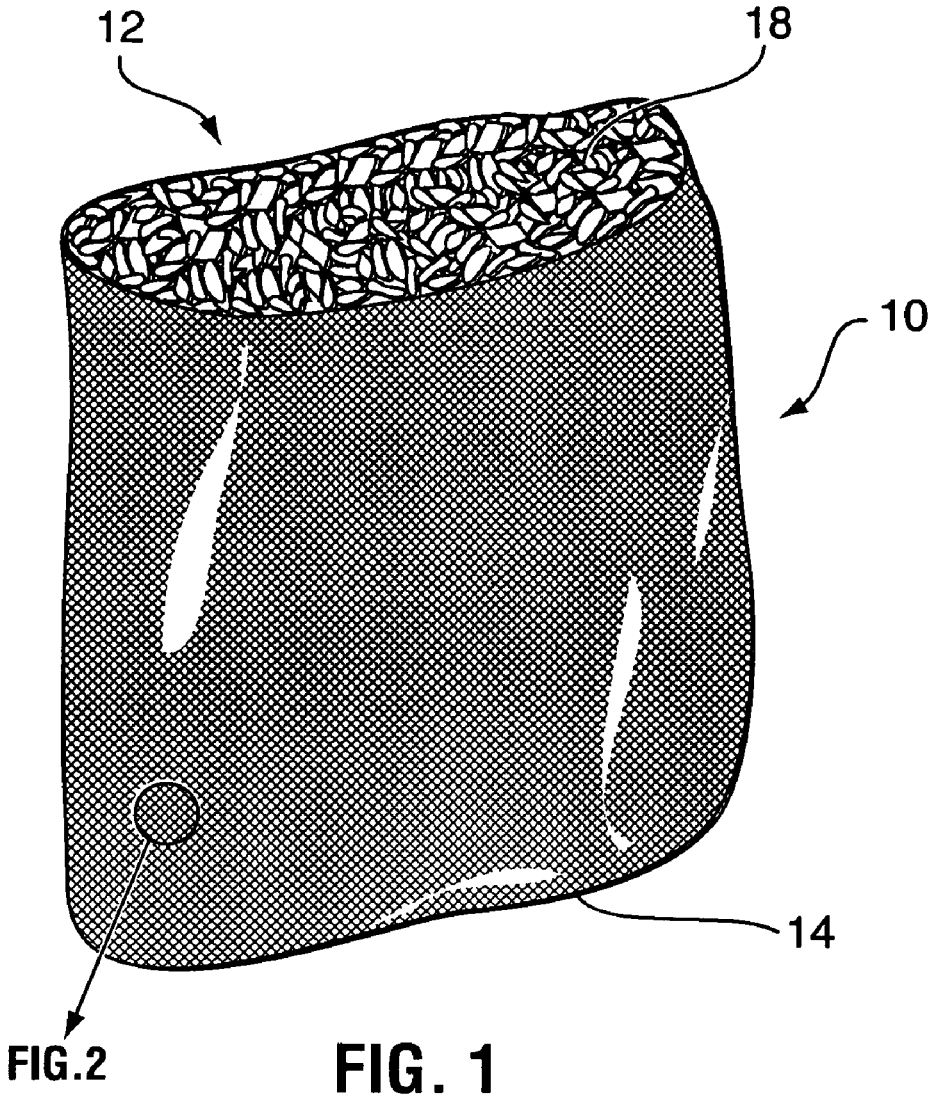
FIG. 1 is a perspective view of one embodiment of the present invention.
Figure 2:
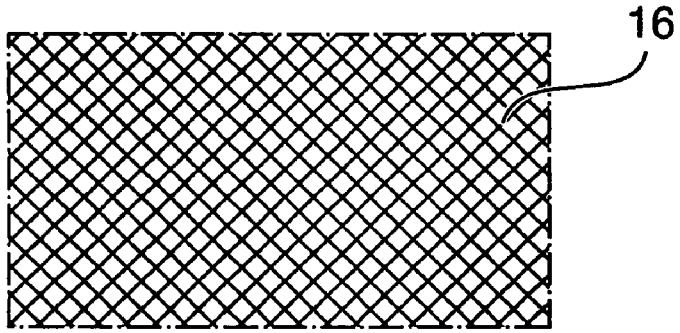
FIG. 2 is an enlarged view of the bag shown in FIG. 1.

With reference to FIG. 1, numeral 10 globally denotes the overall structure, the arrangement comprising a flexible bag, shown in the example to have an open top 12 and a closed bottom 14. The container is made from a flexible material and is additionally mesh, an enlarged view of the mesh being illustrated in FIG. 2 and denoted by numeral 16.

In terms of suitable flexible materials for the container 10, each will be selected from non biodegradable materials which may or may not include UV stabilization compounds in order to prevent UV degradation. This would be required where the bag is in direct exposure to the sun or some other source of ultra violet radiation. With respect to the material of which the bag is made, suitable polymer materials to fulfill this requirement include polyethylene, polypropylene, polystyrene, polyvinyl chloride, polyester inter alia. In certain circumstance, it may be necessary to use high end or high performance materials such as polyvinyl fluoride film.

In order to facilitate water passage and moisture passage, the flexible bag is preferably composed of mesh or otherwise perforated to facilitate or mimic the concept of having a mesh structure. Depending on the intended use of the container, the mesh size may vary substantially from 0.1 mm to 10 mm. As will be appreciated by the user, the mesh pore size will vary depending on the surrounding earth formation and ground hydrology, etc. has high water content or is otherwise exposed to a great deal of drainage, or extremely fine or coarse existing soils.

Generally speaking, the size and charging of the flexible bag will vary from one intended use to another. One possibility is to have a unit approximately 8 feet in overall length and approximately 2 feet in diameter.

Figure 3A:
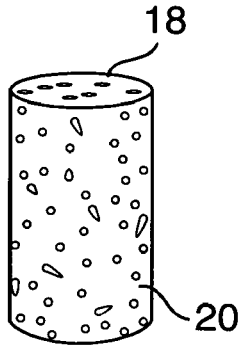
FIGS. 3A through 3C are perspective views of possible shapes for the lightweight, non water retaining, non-biodegradable soil replacement material.
Figure 3B:
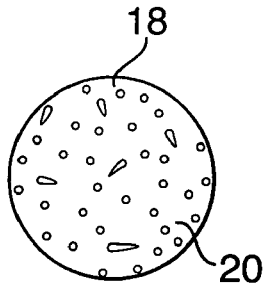
Figure 3C:
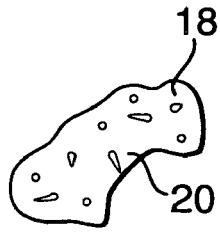

As illustrated in FIG. 1, the bag 10 has an open top; this is simply to illustrate the fact that the bag 10 is charged with granular fill material 18, several examples of shapes of which are illustrated in FIGS. 3A through 3C. In a similar manner to the bag 10, the soil replacement material 18 will comprise a polymeric material and those materials that have been indicated suitable for use in the bag construction will also be readily applicable and useful in the formation of the soil replacement material 18. Although it is not essential, one possible further feature is the provision of apertures 20 in the fill material 18 which may or may not penetrate from one side of the fill material to the other. In the instance where the openings 20 do not penetrate through the entire body, these will function effectively as blind holes and useful to retain moisture for passive evaporation. This will be discussed further in respect of the description for FIG. 6.

Figure 4:
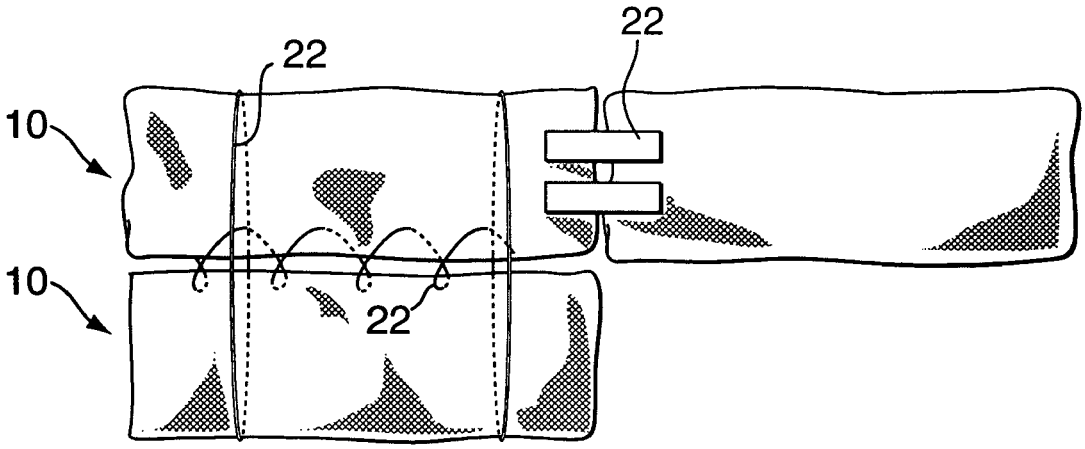
FIG. 4 is a perspective view of an assembly of the filled bags in accordance with one embodiment of the present invention.

With reference to FIG. 4, shown is an assembly of individual containers 10 in the example, each unit 10 is interconnected with a similar unit by fasteners 22. As suitable examples, the fasteners may comprise tape, ties, hook and loupe arrangements, string or other suitable means of fastening units together.

Figure 5:
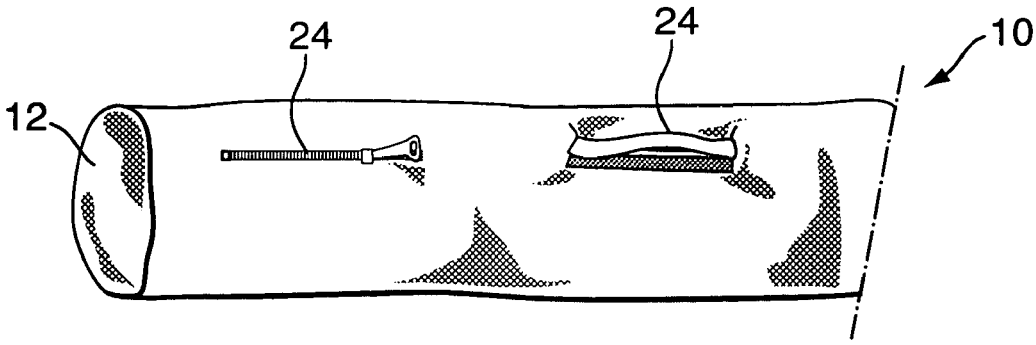
FIG. 5 is a perspective view of the bags illustrating various opening means.

Turning to FIG. 5, shown is a further embodiment of the present invention where the container 10 is closed at both ends 12. In this manner, the container 10 may be opened in a single section and reclosed once the container 10 is charged with filling material 18. As one possible example, a plastic zipper 24 may be employed as shown in the example. As a further alternative, a conventional resealable opening, typically sold under the trademark Ziploc may be employed on the container for resealing purposes once the same has been charged with the material.

Although these examples have been shown with respect to FIG. 5, it will be evident that the container 10, as referenced in FIG. 1, may be sealed by simply tying the open top once charged with a suitable tie (not shown), heat sealed, taped or otherwise fixedly secured to provide a seal.

Figure 6:
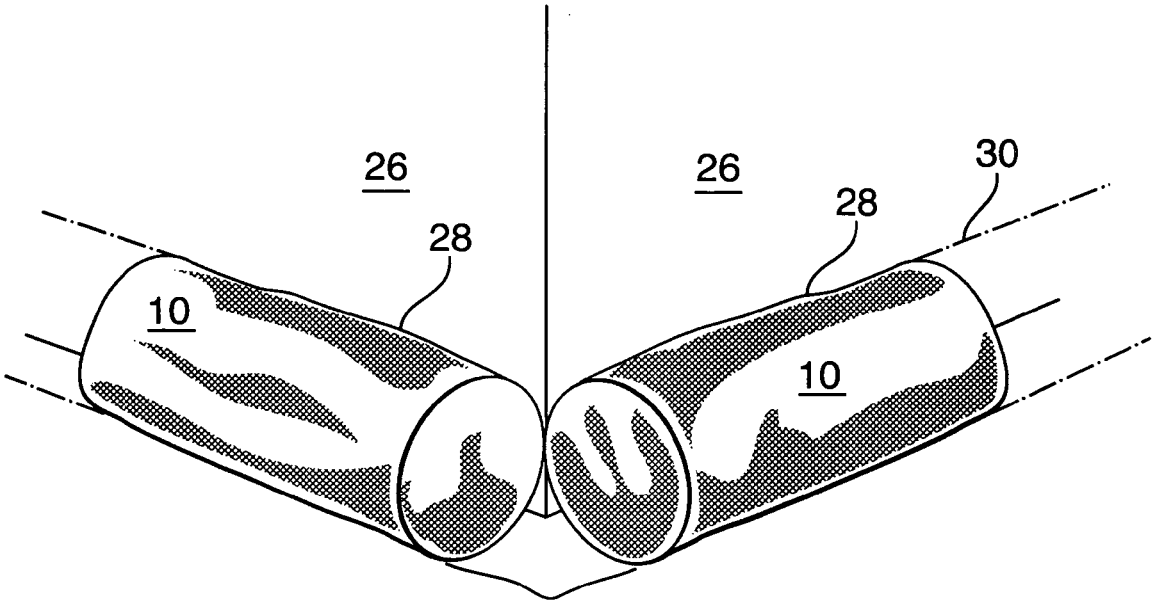
FIG. 6 is a perspective view of the bag in situ.

FIG. 6 illustrates the containers 10, both of which are closed and in situ against the walls 26 of a structure. As illustrated, the containers 10 are below the grade, referenced as numeral 28, of the building. As is known in this field, soil could then be placed against each of the outer surfaces of containers 10 to provide adequate backfill against the walls 26.

As referenced earlier in the specification, the arrangement as illustrated in FIG. 6 has particular advantage in that the filled containers 10 effectively provide a layer of insulation against the exposed surface of the wall 26. The exposed surface is only generally shown in FIG. 6 and referenced by numeral 30. It will be understood that the in FIG. 6, the illustration where the two containers 10 intersect a portion has been left open to simply demonstrate that the two do in fact meet at the corner.

In this application, the size of the openings in the mesh container 10 may be varied from one side of the container to the other to prevent the ingress of moisture through the exposed surface 30 of each of the walls 26. In addition, the backfill within the containers 10 of FIG. 6 (the backfill is not specifically shown) may be of the version that is apertured in order to trap moisture ingress through the mesh container. In this manner, the exposed surface 30 of each wall 26 is effectively thermally insulated as well as protected from moisture transmission.

The non-biodegradable materials may be comprised of recycled plastics as well as virgin plastic and additionally may incorporate other suitable materials made from paper as well as polymeric materials or other suitable recycled composite materials. In terms of the shapes that have been presented for the fill, a specific strength and density of the material selected will, of course, depend on the intended use of the product.

With respect to the flexible bag, the material that will be employed will be subject to substantial variation and will be variable in terms of the tensile strength.

Although embodiments of the invention have been described above, it is not limited thereto and it will be apparent to those skilled in the art that numerous modifications form part of the present invention insofar as they do not depart from the spirit, nature and scope of the claimed and described invention.

We claim:

1. A lightweight soil replacement article, comprising:

a moisture permeable and flexible container composed of a non biodegradable material for allowing the passage of moisture there through; and a lightweight non or minimal water retaining, non biodegradable, fill material composed of granules disposed within said bag, each of said granules including apertures extending at least partially therethrough and at least temporarily retaining moisture for passive evaporation, said bag when filled with said fill material, providing a conformable, soil replacement material to fill an opening.

2. The article as set forth in claim 1, wherein said lightweight, non-biodegradable fill material may be recycled or new material.

3. The article as set forth in claim 1, wherein said fill material comprises granules of a cylindrical shape.

4. The article as set forth in claim 1, wherein said fill material comprises granules of a spherical shape.

5. The article as set forth in claim 1, wherein said fill material comprises granules of an ellipsoidal shape.

6. The article as set forth in claim 1, wherein said flexible bag comprises a polymeric material.

7. The article as set forth in claim 6, wherein said polymeric material is selected from the group consisting of polyethylene, polypropylene, polystyrene, polyvinyl chloride, and polyester.

8. The article as set forth in claim 1, wherein said flexible bag comprises a mesh container.

9. The article as set forth in claim 1, wherein said flexible container has a mesh opening of between 0.1 mm and 10 mm.

10. A method of filling an area to be backfilled, comprising:

providing a synthetic permeable and flexible bag composed of a non biodegradable material capable of allowing the passage of moisture there through;

providing light weight, non bio-degradable fill material composed of granules disposed within said flexible bag, each of said granules including apertures extending at least partially therethrough and at least temporarily retaining moisture for passive evaporation;

filling said bag with said fill material;

sealing said bag; and positioning a charged bag in said area to be filled by conforming said bag to the volume of said area to provide a conformable soil replacement material.

11. The method as set forth in claim 10, further including the step of connecting individual filled bags to form an assembly.

12. The method as set forth in claim 10, wherein said step of sealing comprises heat sealing.

13. The method as set forth in claim 11, wherein said step of connecting individual filled bags to form an assembly comprises filling said bags with a polymeric material that is selected from the group consisting of polyethylene, polypropylene, polystyrene, polyvinyl chloride, and polyester.

* * * * *